US006929225B1

(12) United States Patent
Kent

(10) Patent No.: US 6,929,225 B1
(45) Date of Patent: Aug. 16, 2005

(54) PAINT BRUSH CLIP

(75) Inventor: David Kent, Lake Elsinore, CA (US)

(73) Assignee: Kenmont Industries, LLC, Irvine, CA (US)

( * ) Notice: Subject to any disclaimer, the term of this patent is extended or adjusted under 35 U.S.C. 154(b) by 2 days.

(21) Appl. No.: 10/608,984

(22) Filed: Jun. 26, 2003

(51) Int. Cl.[7] ..... F21V 35/00

(52) U.S. Cl. ..... 248/213.2; 248/110; 248/113; 248/312.1; 220/697; 211/65

(58) Field of Search ..... 248/213.2, 110, 248/206.5, 316.7, 231.81, 113, 312.1; 211/65; 220/697

(56) References Cited

U.S. PATENT DOCUMENTS

| | | | | | |
|---|---|---|---|---|---|
| 2,625,299 | A | * | 1/1953 | Uhlig | 220/736 |
| 2,676,730 | A | * | 4/1954 | Hedglon | 220/697 |
| 2,803,374 | A | * | 8/1957 | Cash | 220/696 |
| 2,906,124 | A | * | 9/1959 | Chaney | 374/194 |
| 3,016,169 | A | | 1/1962 | Kirshenbaum | |
| 3,074,604 | A | * | 1/1963 | Baroud | 222/569 |
| 3,275,187 | A | * | 9/1966 | Lamoureaux | 220/700 |
| 3,536,285 | A | | 10/1970 | Vaughn | |
| 3,729,158 | A | | 4/1973 | Nagy | |
| 3,948,413 | A | * | 4/1976 | Gorrell et al. | 220/696 |
| 4,014,453 | A | * | 3/1977 | Tarnacki | 220/697 |
| 4,101,046 | A | | 7/1978 | Puntillo | |
| 4,266,686 | A | * | 5/1981 | Carter | 220/697 |
| 4,275,818 | A | * | 6/1981 | Church | 220/697 |
| 4,746,042 | A | | 5/1988 | King | |
| 4,991,803 | A | * | 2/1991 | Buder | 248/113 |
| 5,033,704 | A | * | 7/1991 | Kerr | 248/110 |
| 5,083,733 | A | | 1/1992 | Marino et al. | |
| 5,085,386 | A | | 2/1992 | Hicks et al. | |
| 5,375,736 | A | * | 12/1994 | Gonzalez et al. | 220/697 |
| 6,419,194 | B1 | * | 7/2002 | LoSacco et al. | 248/113 |

* cited by examiner

*Primary Examiner*—Kimberly Wood
(74) *Attorney, Agent, or Firm*—MaryJo Redman; Calif Tervo

(57) ABSTRACT

Paint brush clip (10) is for attaching a paint brush (90) to a bucket (80) without obstructing access to paint (95). Clip (10) includes body (30) with flat central portion (31), including magnet (45) and ferromagnetic housing (46). First prong (33) and second prong (34) are attached to body (30). Clip (10) mounts on upper rim (83) of a bucket (80) with body (30) in interior space of bucket (80), retained by compression of prongs (33,34) on outer surface of bucket. Ferrule (91) of brush (90) is removably attached to ferromagnetic housing 46 and prevented from slipping by ridges (41). Handle (50) aids in removing clip (10) from bucket (80).

12 Claims, 2 Drawing Sheets

FIG. 1
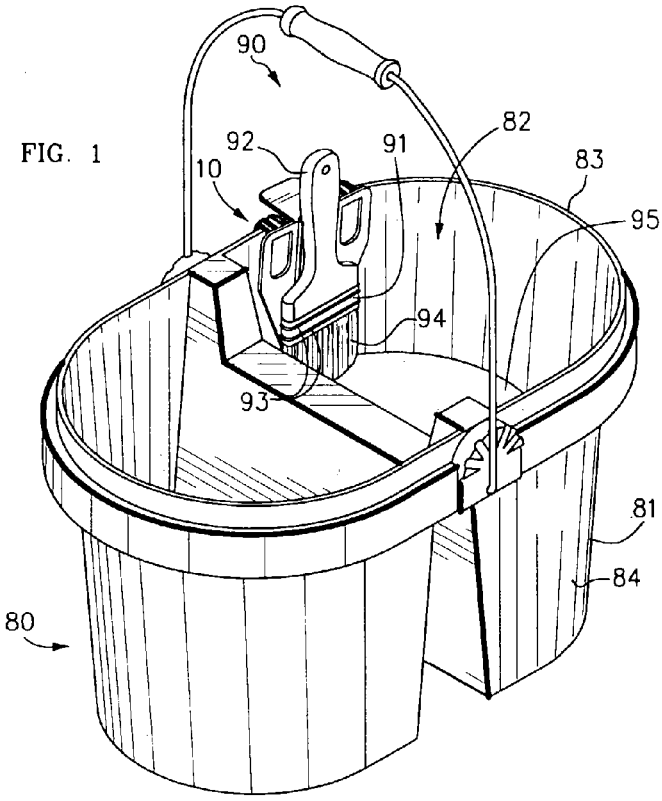
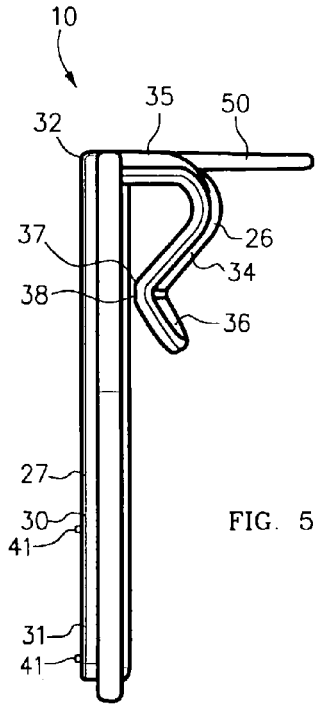
FIG. 5
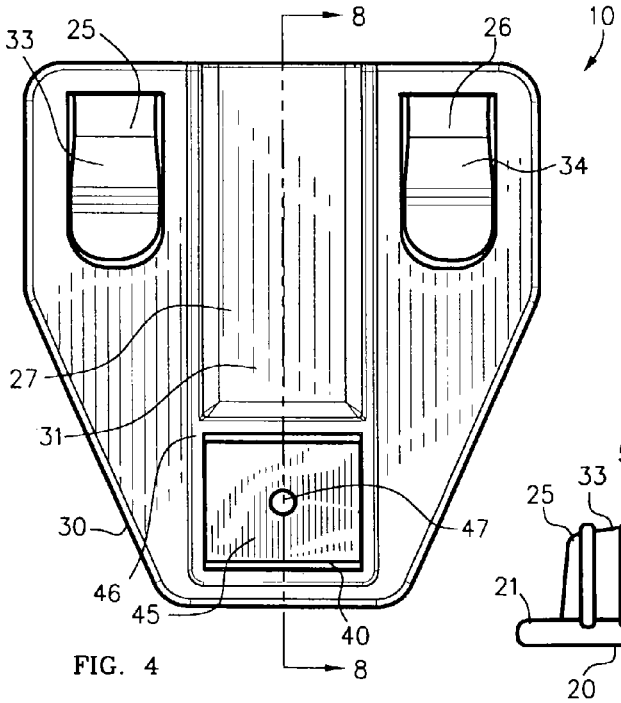
FIG. 4
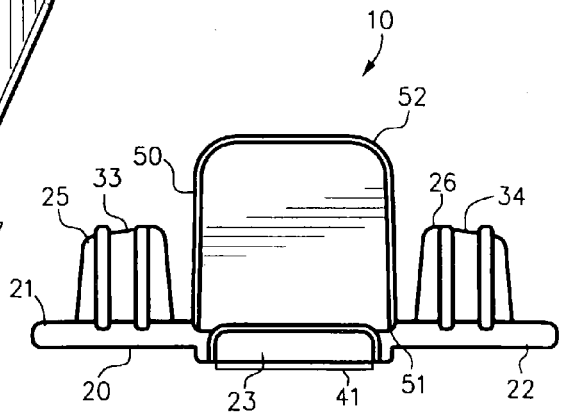
FIG. 6

PAINT BRUSH CLIP

FIELD OF THE INVENTION

This invention relates in general to holders for tools, and more specifically to a holder for a paint brush that may be mounted upon a paint bucket.

BACKGROUND OF THE INVENTION

A house painter generally uses both a roller and a brush on a job, using one or the other as the section being painted requires. The paint is typically contained in a five-gallon pail or a bucket designed especially for holding paint on the job. Both brush and roller can be charged with paint directly from the bucket.

A long-standing problem with alternating between roller and brush is putting the wet brush down while using the roller. If the brush is set down vertically in the paint bucket, leaning against the inner wall of the bucket, the bristles are damaged. The brush may become paint-soaked up to the ferrule or on the handle, making cleaning the brush after use harder and making it more likely the painter will smear paint onto a non-painted surface. The brush may slip or be knocked down into the paint. If the brush is placed horizontally onto a surface, such as a piece of waste paper, the paint runs toward the ferrule and handle, causing the problems noted above. Also, a brush set down flat is more likely to dry out or pick up blown dirt.

Professional painters must be very efficient in order to have competitive prices. They need to maintain their brushes in good condition, not waste motion by moving the brush to get the roller in the bucket, and keep the brush clean so as not to require extra time and solvent for clean-up. Working from a ladder is more efficient if a paint bucket, brush, and roller can be attached together so that all the equipment may be moved or suspended from the ladder as a unit.

Holders for paint brushes have been devised, but they have limitations. Several patented brush holders are designed so as to suspend the brush in the air over the paint bucket. Such holders leave the brush vulnerable to contamination by wind-blown dirt and drying by the sun or wind. When the brush is suspended over the bucket, it interferes with use of the bucket for charging a roller, and the brush may be knocked onto the ground or into the paint accidentally.

Some holders, such as those of Kirshenbaum (U.S. Pat. No. 3,016,169) and Vaughn (U.S. Pat. No. 3,536,285) are designed for use with a one-gallon or smaller paint can. The Kirshenbaum device is a ring attachment that mounts on the rim of the can and includes a paint brush holder. Access to the paint is very restricted when a brush is held by the attachment. The Vaughn device is a small clip that is adjustable to hold the brush with the bristles under the paint.

In spite of the several brush holders that have been disclosed, there is still a need for a brush holder that holds a brush inside a paint bucket, out of the sun and wind, but above the level of the paint. There is further a need for a holder that is easily mounted on any style or size of bucket that does not impede access for charging a paint roller. There is a need for a holder that is easy to use but holds a brush very securely and without allowing the brush to be smeared with paint.

SUMMARY OF THE INVENTION

This invention is a holder for a paint brush that mounts onto the rim of any size or shape of paint bucket. The holder includes a shield-shaped body with two recurved, resilient prongs for clipping over the rim of the bucket. The body rests against the inner wall of the bucket. Unlike brush holders that hang from the bucket rim or are attached with a single clip, the holder of the present invention compresses the wall of the bucket at three points and is very stable and secure.

The three point contact also allows for use of the holder on all buckets. The prongs include contact faces for contacting the outer wall of the bucket. The contact faces are inclined slightly from being parallel to the portion of the body that contacts the inner wall, thus provide more stable contact with a curved bucket wall.

Paint brushes generally include a handle, bristles, and a ferrule that attaches the bristles to the handle. The ferrule is typically of steel or similar ferromagnetic metal and typically includes two or more horizontal ridges.

The brush holder includes magnet means for holding the ferrule of the paintbrush. The magnet means includes a magnet and protruding ridges, for example, a ceramic magnet attached within a three-sided housing of ferromagnetic metal, wherein the edges of the housing project beyond the face of the ceramic magnet. Should the ferrule or magnet means become accidentally coated with liquid paint and slippery, the ridges of the ferrule and of the magnet means cooperate to prevent the brush from slipping more than a few millimeters.

The paint brush is attached and removed from the magnet means very easily and without taking as much care as is necessary for inserting the handle in a clamp or bracket, as in the case of some earlier brush holders.

The brush holder also includes a handle for pushing the holder onto the rile of the bucket or for removing it. When the holder is mounted on a bucket, the handle projects radially outward to the exterior of the bucket and is readily available for grasping and does not obstruct access to the paint.

BRIEF DESCRIPTION OF THE DRAWINGS

FIG. 1 is an environmental perspective view of a preferred embodiment of the clip of the present invention mounted on a bucket and holding a paint brush.

FIG. 4 is a front elevation view of the clip of FIG. 1.

FIG. 5 is a right side elevation view of the clip of FIG. 1 the left side view is a mirror image of FIG. 5.

FIG. 6 is top view of the clip of FIG. 1.

DETAILED DESCRIPTION OF THE INVENTION

Figure 2:
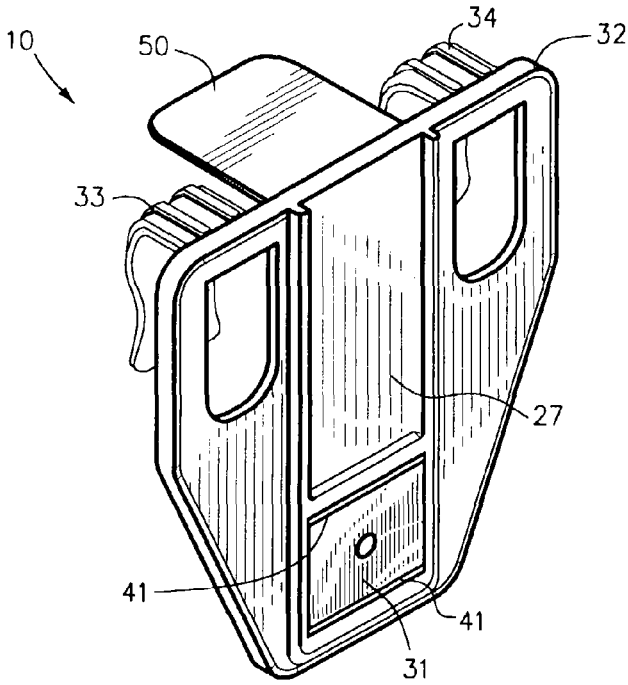
FIG. 2 is a left front perspective view of a preferred embodiment of the clip of FIG. 1.
Figure 3:
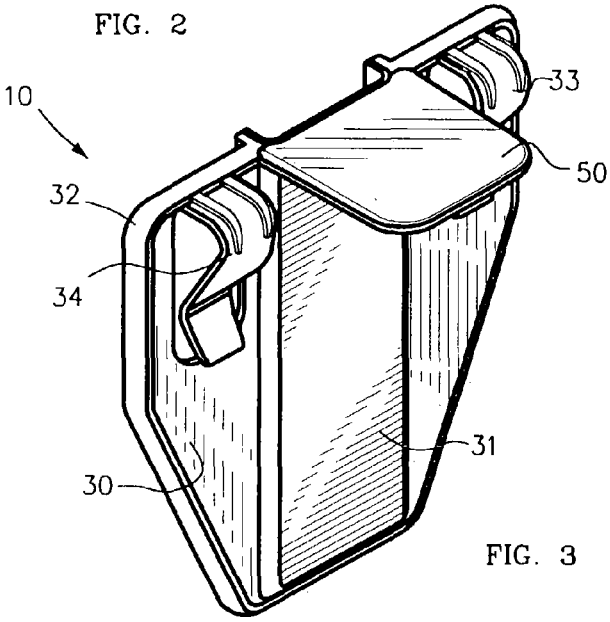
FIG. 3 is a right rear perspective view of the clip of FIG. 1.

FIG. 1 is an environmental perspective view of a preferred embodiment of the clip 10 of the present invention mounted on a bucket 80 and holding a paint brush 90. FIG. 2 is a left front perspective view of a preferred embodiment of clip 10. FIG. 3 is a right rear perspective view of clip 10.

FIG. 4 is a front elevation view of clip 10. FIG. 5 is a right side elevation view of clip 10; the left side view is a mirror image of FIG. 5.

As best seen in FIGS. 4, 5, and 6, clip 10 includes a body 30, a first prong 33, a second prong 34, and a handle 50. Body 30 includes an upper spine portion 32, and a flat central portion 31. Both prongs 33,34 have an attached end 35 attached to body 30, a free end 36 opposite attached end 35, and a contact portion 37 for contacting bucket 80. Prongs 33,34 are recurved to provide good tension yet allow easy mounting of clip 10 onto bucket 80. Handle 50 has an attached end 51 attached to upper spine portion 32 of body 30 and a free end 52 opposite attached end 51.

As seen in FIG. 1, bucket 80 includes an interior space 82 for containing paint 95, enclosed by a wall 81, which includes an exterior surface 84 and an upper rim 83.

Paint brush 90 includes a handle 92 and a ferrule 91 for retaining the bristles 94. Ferrule 91 is of ferromagnetic material, typically steel, and includes one or more horizontal ridges 93.

Figure 7:
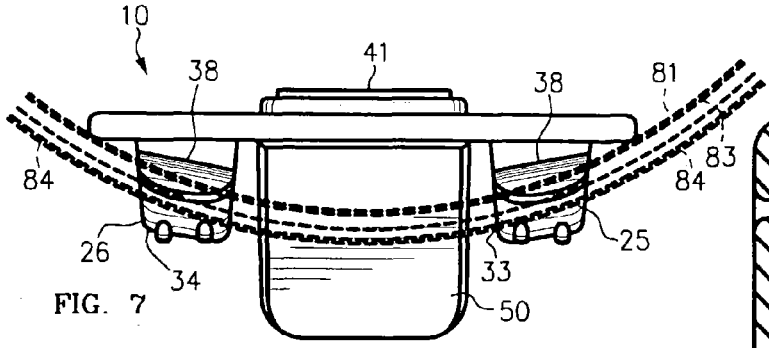
FIG. 7 is a bottom view of the clip of FIG. 1 shown mounted upon the wall of a paint bucket, the wall being cut away and depicted in phantom.
Figure 8:
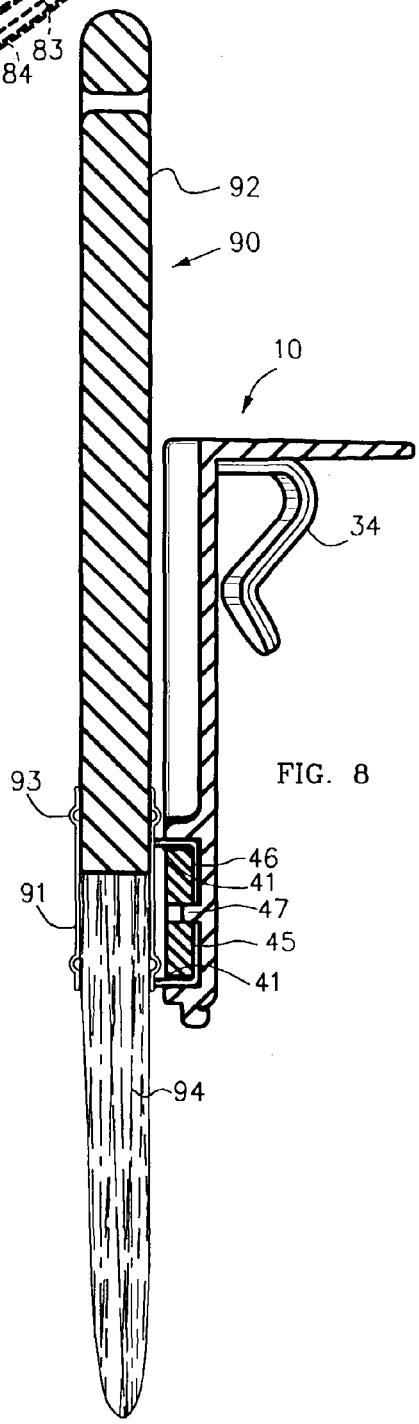
FIG. 8 is a section view of the clip of FIG. 1 taken along line 8—8 of FIG. 4 and with a paint brush shown attached.

FIG. 6 is a top view of clip 10. FIG. 7 is a bottom view of clip 10 shown mounted upon the wall 81 of a paint bucket 80, wall 81 being cut away and depicted in phantom. FIG. 8 is a section view of clip 10 taken along line 8—8 of FIG. 4 and with paint brush 90 shown attached.

Clip 10 is mounted on paint bucket 81 by positioning clip 10 over upper rim 83 and pushing down on handle 50 such that the respective contact portions 37 of both prongs 33,34 contact exterior surface 84 of wall 81 and body 30 is within interior space 82 of bucket 80. Once mounted clip 10 compresses wall 81 at three points both contact portions 37 press inwardly against exterior surface 84 and back side 39 of body 30 presses outwardly. Both prongs 33,34 are sufficiently resilient to accommodate a wide range of thickness and degree of curvature of wall 81. Clip 10 is unmounted from bucket 80 by pulling upwardly on handle 50.

Clip 10 may be of any suitable material. For example, injection-molded polypropylene has been found to have a desirable combination of stiffness and resiliency. It is desirable that central portion 31 of body 30 be stiff and resistant to impacts, yet prongs 33,34 must be resilient to mount easily onto upper rim 83 and provide strong compression of wall 81 over a long lifetime of use. Depending largely upon the web thickness and cross-sectional shape of a given portion of clip 10, and also somewhat upon details of the molding process, the different portions of clip 10 may be designed to have different mechanical properties, as is well known in the art.

Central portion 31 of body 30 includes magnet means 40 for attaching ferrule 91 of brush 90 to clip 10, and thus to bucket 80.

Magnet means 40, best seen in FIGS. 4 and 8, includes a magnet housing 46 and a ceramic magnet 45. Magnet housing 46 has the shape of a three-sided box, attached to central portion 31, such as in a shallow molded-in depression of central portion 31. Magnet housing 46 is attached by suitable means, such as by screw 47 or by adhesive. Magnet housing 46 is made of a ferromagnetic material, such as steel or nickel. Ceramic magnet 45 is attached to magnet housing 46.

Magnet housing 46 includes ridges 41 that protrude beyond the surface of ceramic magnet 45 and other parts of central portion 31. When brush 90 is attached to clip 10, ferrule 91 contacts only ridges 41. Because magnet housing 46 is composed of ferromagnetic material, the contact with ceramic magnet 45 induces magnetic force in magnet housing 46, which attracts ferrule 91. In addition to the magnetic interaction of ridges 41 and ferrule 91 mechanical interaction between ridges 41 and horizontal ridges 93 of brush 90 prevents brush from slipping vertically downward relative to magnet means 40.

Preferably, ridges 41 protrude beyond all other parts of central body 31 farther than ridges 93 protrude from all other parts of ferrule 91, such that only ridges 41 can contact ferrule 91 when brush 90 is attached to clip 10.

Each contact portion 37 of prongs 33,34 includes a generally planar contact face 38. As best seen in the bottom view of FIG. 7, contact faces 38 are inclined at mirror-image angles from being parallel to the plane of body 30. This inclination allows each contact face 38 to contact more fully exterior surface 84 of a curved bucket 80, within a wide range of curvature.

Although clip 10 is depicted in the drawings herein as including a generally flat, shield-shaped body 30, the invention may also be described in more basic terms as comprising a horizontal spine 20 (seen in FIG. 6), having a first end 21, second end 22, and middle portion 23 therebetween. First prong 25 is attached to first end 21 and second prong 26 is attached to second end 22. A center prong 27 is attached to middle portion 23 and includes magnet means 40. Using these terms, when clip 10 is mounted onto upper rim 83, center prong 27 is inserted into interior space 82 of bucket 80 and prongs 25,26 contact exterior 84 of wall 81.

Although particular embodiments of the invention have been illustrated and described, various changes may be made in the form, composition, construction; and arrangement of the parts-herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A clip for mounting on a bucket and for holding a paint brush, having a ferrule of ferromagnetic material; the bucket including: a wall enclosing an interior space for containing paint; the wall including an upper rim and an outer face; said clip including:

a spine; including:

a first end;

a second end; and a middle portion between said first and second ends;

a first end prong attached to said first end of said spine and extending downward, a second end prong attached to said second end of said spine and extending downward, and a center prong attached to said middle portion of said spine and extending downward, for insertion into the interior space of the bucket; said center prong including:

magnet means for holding the ferrule of the brush; including:

a magnet; and a ferromagnetic housing for said magnet; including:

a plurality of horizontal ridges extending beyond said magnet for contacting the ferrule of the paint brush; said housing being attached to said center prong and said magnet being attached to said housing.

2. The clip of claim 1, said clip further including:

a handle attached to said middle portion and extending radially outward from the upper rim of the wall of bucket when said clip is mounted upon the upper rim of the wall of the bucket, such that said handle does not interfere with access to the interior space of the bucket.

3. The clip of claim 1, said clip being of resilient plastic with the exception of said magnet means.

4. A clip for mounting on a bucket and for holding a paint brush, having a ferrule of ferromagnetic material; the bucket including: a wall enclosing an interior space for containing paint; the wall including an upper rim and an outer face; said clip including:

a body; including:
- a flat central portion; and
- an upper spine portion;

a first prong; including:
- an attached end attached to said body;
- a free end; and
- a contact portion for contacting the outer face of the wall of the bucket;

a second prong; including:
- an attached end attached to said body;
- a free end; and
- a contact portion for contacting the outer face of the wall of the bucket; and magnet means for holding the ferrule of the brush; including:
- a magnet; and
- a ferromagnetic housing for said magnet; including:
  - a plurality of horizontal ridges extending beyond said magnet for contacting the ferrule of the paint brush; said housing being attached to said flat central portion and said magnet being attached to said housing; said first and said second prongs being spaced apart on opposite sides of said flat central portion; and said clip being adapted to mount securely upon the upper rim of the wall of the bucket with said free ends of said first and second prongs disposed outside the bucket and said contact potions of each said prong pressing against the outside face of the wall of the bucket; and said flat central portion and said magnet means disposed within the interior space of the bucket.

5. The clip of claim 4, further including:

a handle attached to said upper spine portion for grasping said clip.

6. The clip of claim 5, said handle extending radially outward from the upper rim of the wall of the bucket when said clip is mounted upon the upper rim, such that said handle does not interfere with access to the interior space of the bucket.

7. The clip of claim 4, said clip being of resilient plastic with the exception of said magnet.

8. The clip of claim 4, each said contact portion including:

a generally planar contact face; each said contact face inclined at a slight angle from being parallel to said flat central portion so as to adapt each said contact face for contact with the outer face of a generally cylindrical bucket.

9. In combination:

a bucket; including:
- a wall enclosing an interior space for containing paint; including:
  - an exterior surface; and
  - an upper rim;

a paint brush; including:
- bristles;
- a handle; and
- a ferrule for attaching said bristles to said handle; including:
  - a horizontal ridge; and a paint brush holder; including:

a body; including:
- a flat central portion; and
- an upper spine portion;

a first prong; including:
- an attached end attached to said body;
- a free end; and
- a contact portion for contacting said outer face of said wall of said bucket;

a second prong; including:
- an attached end attached to said body;
- a free end; and
- a contact portion for contacting said outer face of said wall of said bucket; and magnet means for holding said ferrule of said brush; including:
- a magnet; and
- a ferromagnetic housing for said magnet; including:
  - a plurality of horizontal ridges extending beyond said magnet for contacting the ferrule of the paint brush, said housing being attached to said flat central portion and said magnet being attached to said housing, said first and said second prongs being spaced apart on opposite sides of said flat central portion; and said clip being adapted to mount securely upon said upper rim of said wall of said bucket with said free ends of said first and second prongs disposed outside said bucket and said contact potions of each said prong pressing against said outside face of said wall of said bucket; and said flat central portion and said magnet means disposed within said interior space of the bucket.

10. The combination of claim 8, said paint brush holder further including:

a handle attached to said body for grasping said paint brush holder.

11. The combination of claim 9, said handle extending radially outward from said upper rim of said wall of said bucket when said clip is mounted upon said upper rim, such that said handle does not interfere with access to said interior space of said bucket.

12. A clip for mounting on a bucket and for holding a paint brush having a ferrule of ferromagnetic material; the bucket including: a wall enclosing an interior space for containing paint; the wall including an upper rim and an outer face; said clip including:

a body of resilient plastic; including:
- a flat central portion;
- an upper spine portion; and
- a handle attached to said upper spine portion and extending laterally, radially outward from the upper rim of the wall of the bucket when said clip is mounted on the bucket such that said handle does not interfere with access to the interior space of the bucket a first prong; including:
- an attached end attached to said body;
- a free end; and
- a contact portion for contacting the outer face of the wall of the bucket;

a second prong; including:

an attached end attached to said body;

a free end; and a contact portion for contacting the outer face of the wall of the bucket; and magnet means for holding the ferrule of the brush; comprising:

a ceramic magnet; and a housing for said ceramic magnet including:

a plurality of ridges extending beyond said ceramic magnet for contacting the ferrule of the paint brush; said housing being of a ferromagnetic material;

said housing being attached to said flat central portion and said ceramic magnet being attached to said housing; and said first and said second prongs being spaced apart on opposite sides of said flat central portion; and said clip being adapted to mount securely upon the upper rim of the wall of the bucket with said free ends of said first and second prongs disposed outside the bucket and said contact potions of each said prong pressing against the outside face of the wall of the bucket; and said flat central portion and said magnet means disposed within the interior space of the bucket.

* * * * *